US008096012B2

(12) United States Patent
Lubart

(10) Patent No.: US 8,096,012 B2
(45) Date of Patent: Jan. 17, 2012

(54) OUTSOLE GRID CLEANER

(75) Inventor: Randy N. Lubart, Palm Beach Gardens, FL (US)

(73) Assignee: Shoes For Crews, LLC, West Palm Beach, FL (US)

( * ) Notice: Subject to any disclaimer, the term of this patent is extended or adjusted under 35 U.S.C. 154(b) by 429 days.

(21) Appl. No.: 12/356,910

(22) Filed: Jan. 21, 2009

(65) Prior Publication Data

US 2010/0180394 A1 Jul. 22, 2010

(51) Int. Cl.
*A47L 23/04* (2006.01)

(52) U.S. Cl. ... 15/237; 15/143.1; 15/236.06; 15/236.08; 15/236.09; 36/59 R; D32/47

(58) Field of Classification Search ..... 15/104.001, 15/104.5, 142, 143.1, 236.01, 237, 236.05, 15/236.06, 236.08, 236.09; 30/169, 172, 30/314, 315; 36/59 R, 59 C; D32/46–49
See application file for complete search history.

(56) References Cited

U.S. PATENT DOCUMENTS 2,360,745 A * 10/1944 Vogel ..... 15/167.1
2,380,855 A * 7/1945 Lower ..... 15/236.05
3,045,270 A 7/1962 Blumlo
3,310,879 A * 3/1967 Brzezinski et al. ..... 33/501
3,994,040 A * 11/1976 DiStefano ..... 15/236.06
4,571,767 A 2/1986 Daugler
4,908,899 A * 3/1990 Killen ..... 15/105
5,121,519 A * 6/1992 Haugom ..... 15/105
5,509,167 A * 4/1996 Wilson ..... 15/237
5,653,818 A * 8/1997 Genardi ..... 134/6
5,970,561 A 10/1999 Archibeque
7,263,738 B2 * 9/2007 Moore ..... 15/111
2002/0078598 A1 * 6/2002 Bell ..... 36/59 R

FOREIGN PATENT DOCUMENTS

GB 2241879 * 9/1991
JP 3-258272 * 11/1991

* cited by examiner

*Primary Examiner* — Mark Spisich
(74) *Attorney, Agent, or Firm* — McHale & Slavin, P.A.

(57) ABSTRACT

An outsole grid cleaner for removing dirt and debris from the sole of shoes includes a base and a plurality of scraper prongs which remove dirt and debris from the shoe's sole. The outsole grid cleaner has one continuous sidewall extending peripherally around the device. A plurality of scraper prongs extend outwardly from the sidewall. The plurality of scraper prongs have a free end. The plurality of scraper prongs are manipulated through a shoe's outsole pattern of projections to forcibly remove debris and dirt from the lowermost surface of the shoe's outsole pattern. The scraper prongs also remove dirt and debris when in contact with the channel on the top surface of the shoe sole's projections. The scraper prongs further remove the dirt and debris when in contact with the top surface of the shoe sole's projections.

17 Claims, 5 Drawing Sheets

OUTSOLE GRID CLEANER

FIELD OF THE INVENTION

This invention relates generally to a cleaner for shoe soles, and more particularly, to an outsole grid cleaner for shoe soles having a corrugated sole pattern.

BACKGROUND OF THE INVENTION

The sole of a shoe is to provide traction. Generally, the soles reflect the need of the wearer so as to adapt to specific floor surfaces and enhance specific performance. The traction of a shoe sole is a measure of the friction between the sole and the floor surface; and is directly related to the materials used in the construction thereof and the pattern thereon. However, in certain conditions, due to weather, terrain, work conditions, or the like, shoes may accumulate dirt, debris, grease, solid material, and/or water so as to stick to the shoe soles. The dirt, debris, grease, solid material, and/or water can accumulate on shoe soles and thus diminish traction. Furthermore, if dirt, debris, grease, solid material, and/or water attaches to shoe soles having customized soles for specific functions or performances, then the traction on the customized sole is severely hampered and the shoes may no longer perform in the matter in which they were intended.

Various devices have been employed to reduce or remove the accumulation of dirt, debris, grease, solid material, and/or water found on shoe soles. For instance, a mat is typically placed at the entryway of building structures; or for instance, U.S. Pat. No. 5,970,561 discloses a mat attachable to a golf bag. Generally, mats are provided with bristles or bumps to assist in the cleaning of the sole of a shoe. The mat provides a brushing or wiping action against the shoe's sole as the wearer steps thereon. The wearer brushes the sole over the surface of the mat; however, the relative motion between the sole and the bristles or bumps on the mat provide an ineffective method of eliminating all the dirt, grease, solid material, and/or water from the shoe sole. Experience has shown that larger solid materials typically remain clinging to the soles even when the user is aware of the presence thereof and carefully brushes the soles against the mat. Furthermore, if the wearer brushes the sole in a longitudinal direction and the sole profile comprises a herringbone pattern, then the wearer is not effectively cleaning the soles. It would be more effective to brush the soles against the mat in a latitudinal direction if the sole has a herringbone pattern; however to ask the wearer to keep in mind the configuration of the sole pattern as the wearer brushes the shoe sole against a mat is impractical.

A practical method of removing dirt and debris from the soles of shoes is to use a tree stem as a 'pick' to pry dirt and debris from the outsole pattern on a shoe. Unfortunately, a tree stem is not always readily available. Furthermore, not every tree stem has a corresponding diameter equal to the pattern on a shoe sole. In order to fully remove all dirt and debris from the shoe's outsole pattern, it is necessary to get within the grooves and channels on the shoe's outsole pattern. If the diameter of the tree stem is larger than the groove and channel on the outsole, then the dirt and debris within the groove and channel is not removed. If the diameter of the tree stem is smaller than the groove and channel on the outsole, then the wearer is required to tediously manipulate the tree stem about the groove and channel to remove all dirt and debris from the outsole. Overcoming the practical method of removing dirt and debris is U.S. Pat. No. 4,571,767, which discloses a cleaner having a brush mounted on the end of a tubular shaft. The drawback of the cleaner is it is designed to be transported within a golf bag, and thus would soil the golf bag and is not practical for everyday use. U.S. Pat. No. 3,045,270 discloses a scraping tool for scraping corrugated soles of a shoe having parallel rows of ribs extending thereacross. The drawback associated with this device is that dirt and debris is only removed from within the ribs of the pattern and not the top surface thereof.

While these prior art devices may be suitable for the particular purpose to which they address, these prior art devices would not be suitable for the purposes of the present invention as heretofore described. What is needed is a remover of dirt and debris from a shoe's sole that is conveniently available and is capable of removing dirt and debris from the grooves between projections on an outsole pattern, the channels on the top surface of the projections, and the top surface of the projections on the outsole pattern without any finagling.

SUMMARY OF THE INVENTION

An outsole grid cleaner for removing dirt and debris from the sole of shoes includes a base and a plurality of scraper prongs which remove the dirt and debris from the shoe's sole. The outsole grid cleaner has one continuous sidewall extending peripherally around the device. A plurality of scraper prongs extend outwardly from the sidewall. The plurality of scraper prongs have a free end. The plurality of scraper prongs are manipulated through a shoe's outsole pattern of projections to forcibly remove debris and dirt from the lowermost surface of the shoe's outsole pattern, the grooves. The scraper prongs also remove dirt and debris when in contact with the channel on the top surface of the shoe sole's projections. The scraper prongs further remove the dirt and debris when in contact with the top surface of the shoe sole's projections.

Accordingly, it is an objective of the present invention to provide an outsole grid cleaner for shoe soles and in particular, footwear having a slip resistant outsole.

It is a further objective of the present invention to provide an outsole grid cleaner including scraper prongs which are used to ensure the quick removal of dirt and debris from shoe soles.

It is a further objective of the present invention to provide an outsole grid cleaner including a plurality of scraper prongs extending outwardly from a base, each scraper prong has a length, whereby each adjacent prong has a differing length and the lengths of each scraper prong progressively increases.

It is yet a further objective of the present invention to provide an outsole grid cleaner whereby the longest scraper prong cooperates with a groove between projections on a shoe's outsole pattern, the adjacent smaller scraper prong cooperates with a channel on the top surface of the shoe sole's projections, and the adjacent shortest scraper prong cooperates with the top surface of the shoe sole's projections.

It is yet a further objective of the present invention to provide an outsole grid cleaner whereby the plurality of scraper prongs cooperates with adjacent grooves between the shoe sole's projections, or cooperates with adjacent channels on the shoe sole's projections, or cooperates with the top surfaces of the shoe sole's projections.

It is still yet an additional objective of the present invention to provide an outsole grid cleaner having scraper prongs which have a corresponding diameter to the grooves between the projections and the channels on the top surfaces of the projections on the outsole of a shoe.

It is an additional objective of the present invention to provide an outsole grid cleaner being manually held to provide a compact, lightweight device with a means for scraping or removing dirt and debris from the sole of a shoe.

It is an additional objective of the present invention to provide an outsole grid cleaner which is attachable to a key chain so as to be readily available to the wearer.

It is also an objective of the present invention to provide an outsole grid cleaner which quickly and effectively, with a minimum of effort, cleanses shoe soles.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
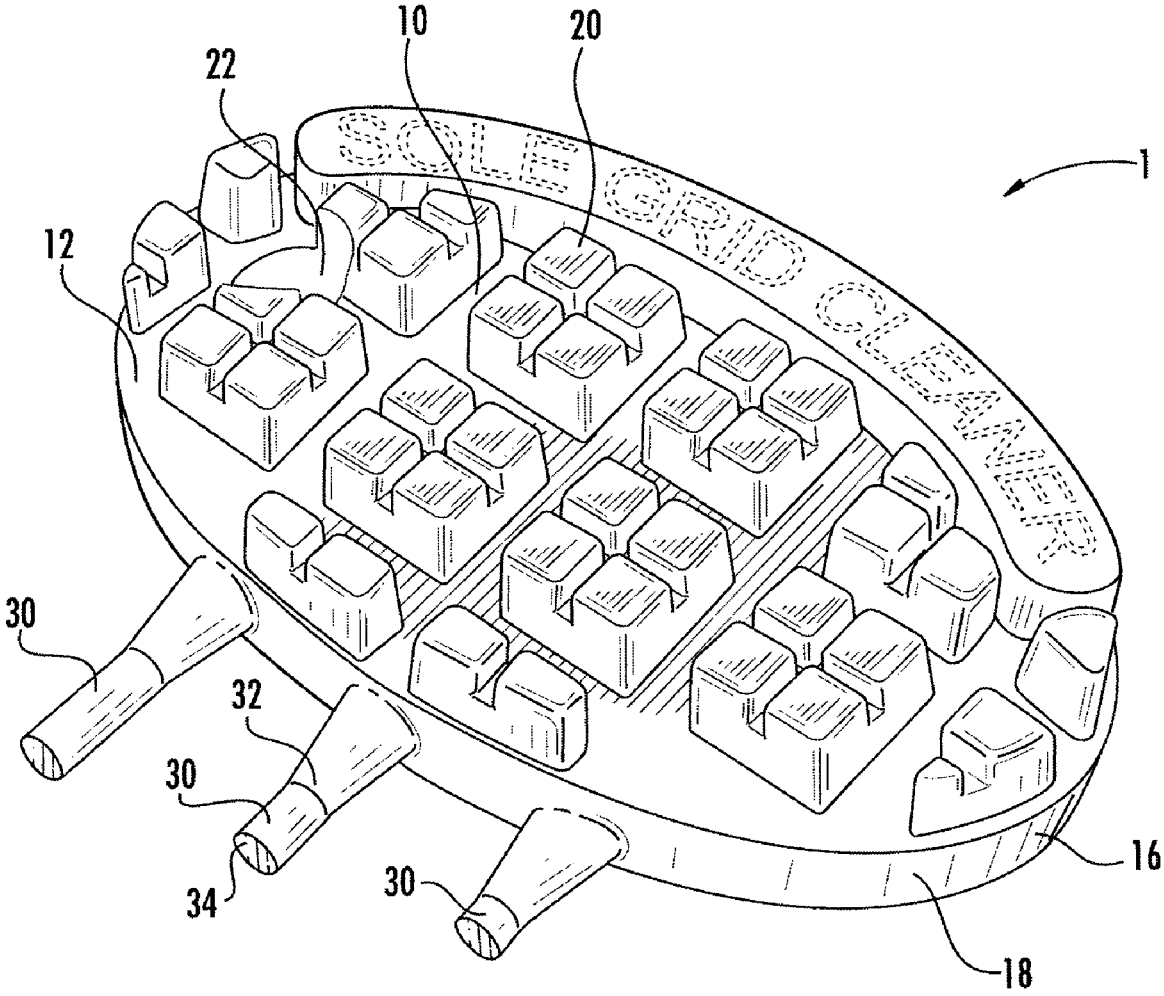
FIG. 1 is a perspective view of an outsole grid cleaner of the present invention.
Figure 2:
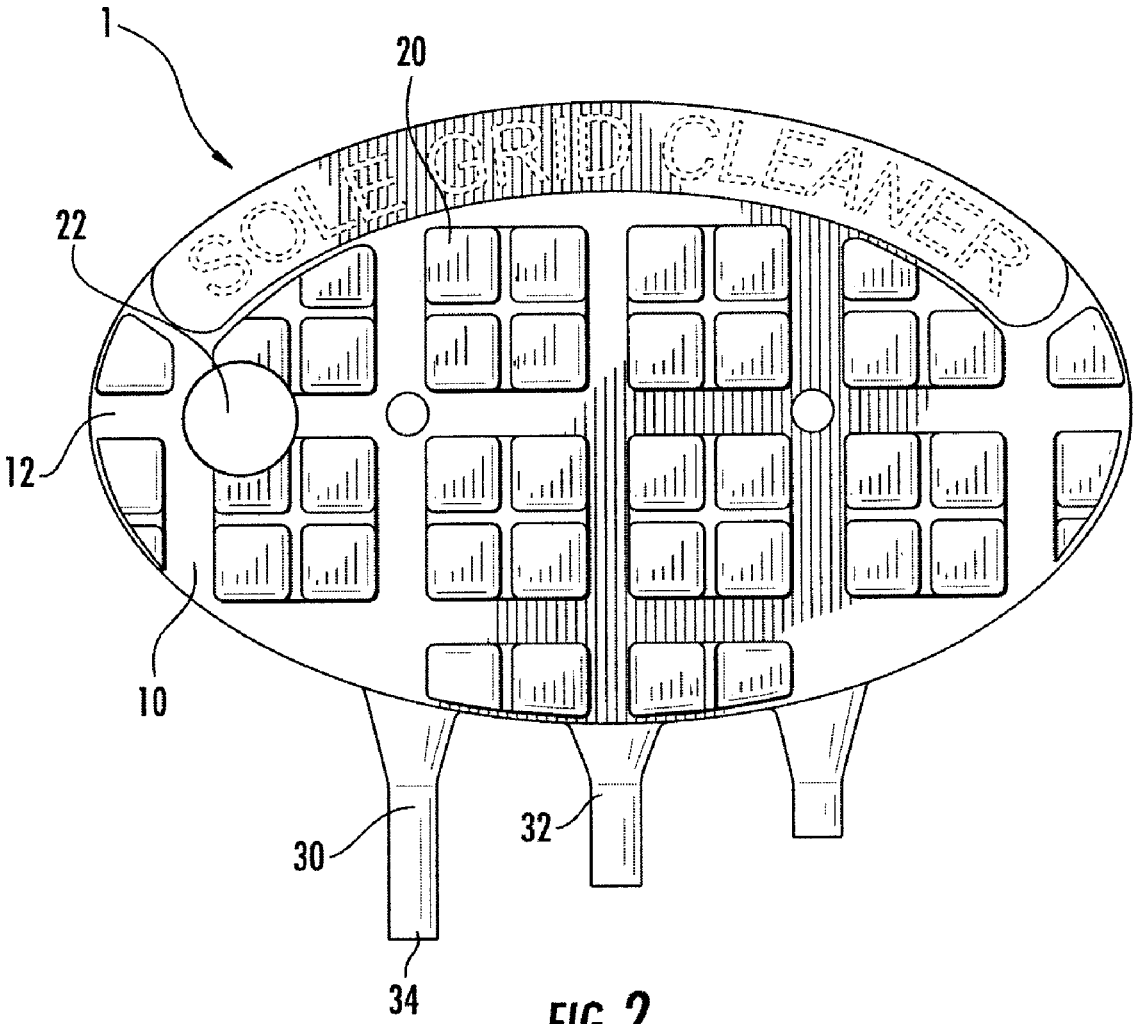
FIG. 2 is a top view of an outsole grid cleaner of the present invention.
Figure 3:
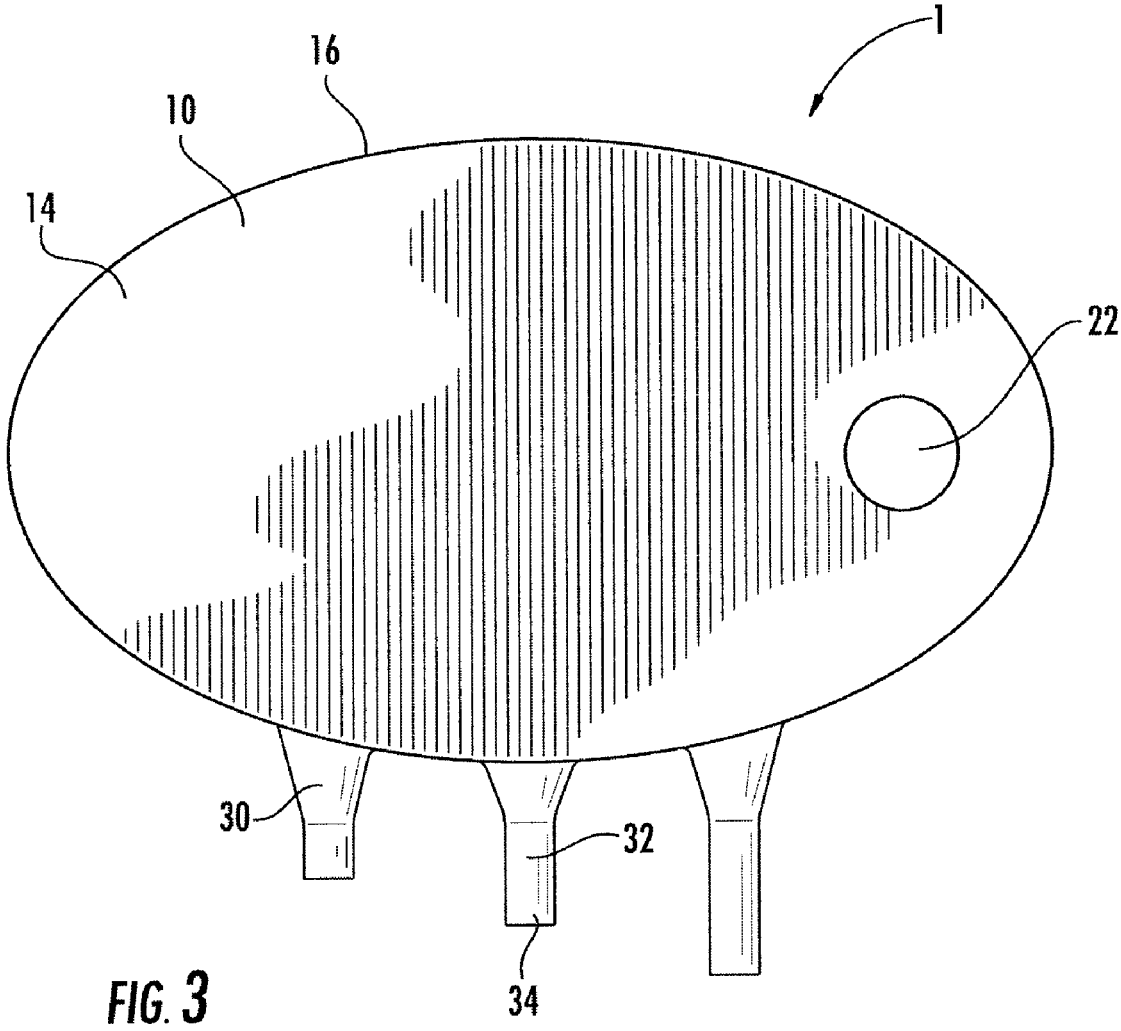
FIG. 3 is a bottom view of an outsole grid cleaner of the present invention.

Referring now to FIGS. 1-5, wherein like components are numbered consistently throughout. FIGS. 1-3 illustrate the preferred embodiment of an outsole grid cleaner 1. As shown, the outsole grid cleaner 1 includes a base 10 and a plurality of scraper prongs 30. The base 10 has an oval cross-section with a top surface 12 and a bottom surface 14. The oval cross-section provides a suitable handle for an individual to hold on to. However, it is contemplated that the base 10 may depart from an oval cross-section should other suitable cross-sections provide a suitable handle, such as, but not limited to, circular, rectilinear, or the like. The base 10 further includes at least one continuous sidewall 16. The sidewall 16 extends from the top surface 12 to the bottom surface 14 and includes an outer peripheral surface 18. Alternative embodiments of the outsole grid cleaner 1 contemplate the construction of the base 10 as a frame having at least one continuous sidewall, and the sidewall defining an opening. The alternative construction allows a shoe wearer to use the sidewall as a handle for manipulation of the base through a shoe sole without departing from the scope of the invention. The top surface 12 of the base 10 includes a pattern 20 similar to that seen on shoe soles manufactured by SHOES FOR CREWS® (footwear having a slip resistant outsole). Many patterns are contemplated for use on outsoles such as herringbone, or the like. However, the preferred embodiment illustrates the outsole grid cleaner 1 with a corrugated pattern 20 on the top surface 12. The corrugated pattern 20 on the top surface 12 provides an aesthetic feature making the outsole grid cleaner 1 recognizable. The corrugated pattern 20 further provides a gripping means for the shoe wearer when handling the base 10 as the wearer manipulates the outsole grid cleaner 1 through a shoe sole. The base 10 also further includes an aperture 22 extending from the top surface 12 to the bottom surface 14. The aperture 22 is provided for attachment to a keychain, shoe string, or the like, so as to keep the outsole grid cleaner 1 in a convenient place for the shoe wearer. The base 10 is preferably constructed of a plastic polymer or other suitable material.

Figure 4:
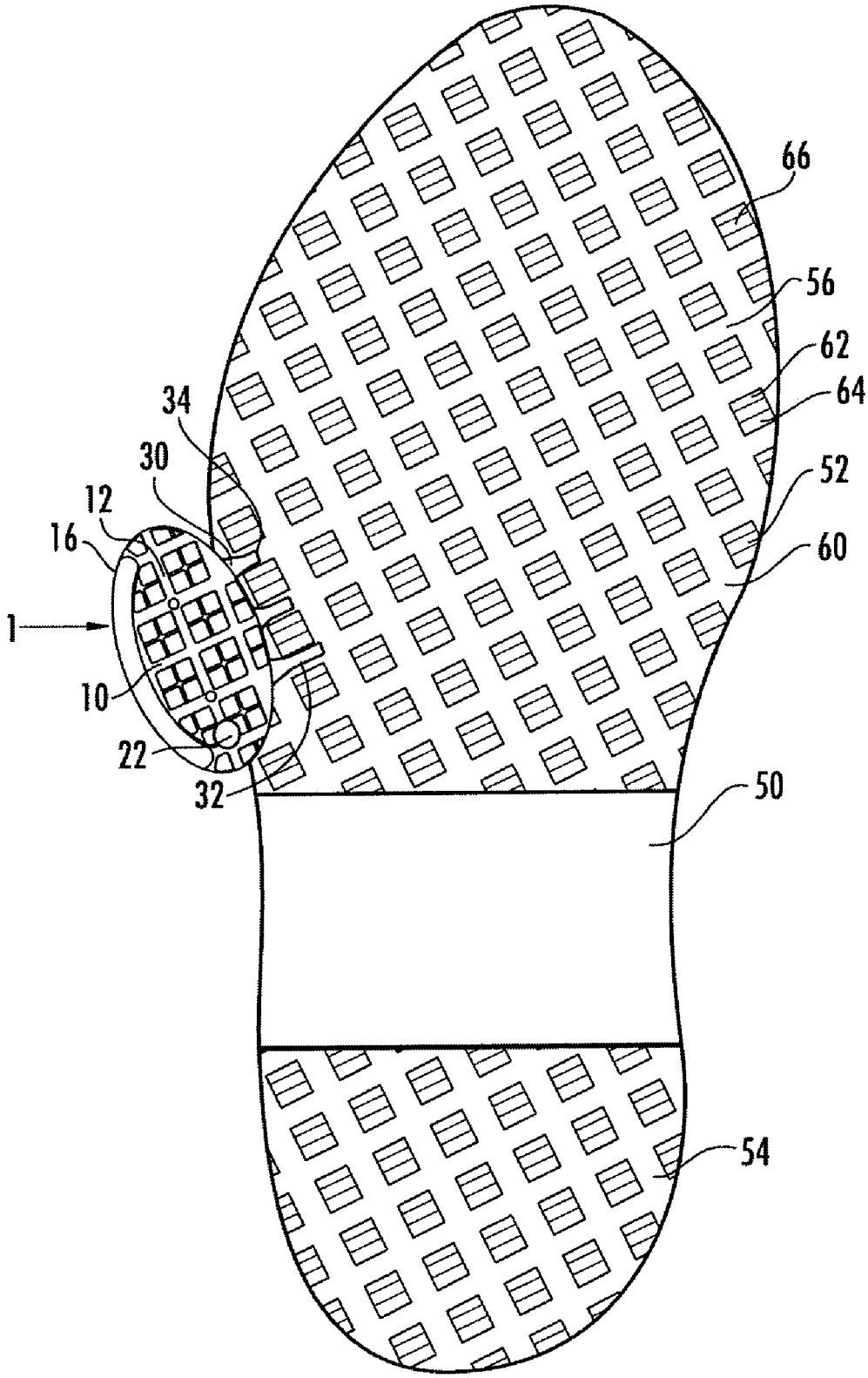
FIG. 4 is a bottom view of a shoe sole and an embodiment of the outsole grid cleaner of the present invention applied to the shoe sole.
Figure 5:
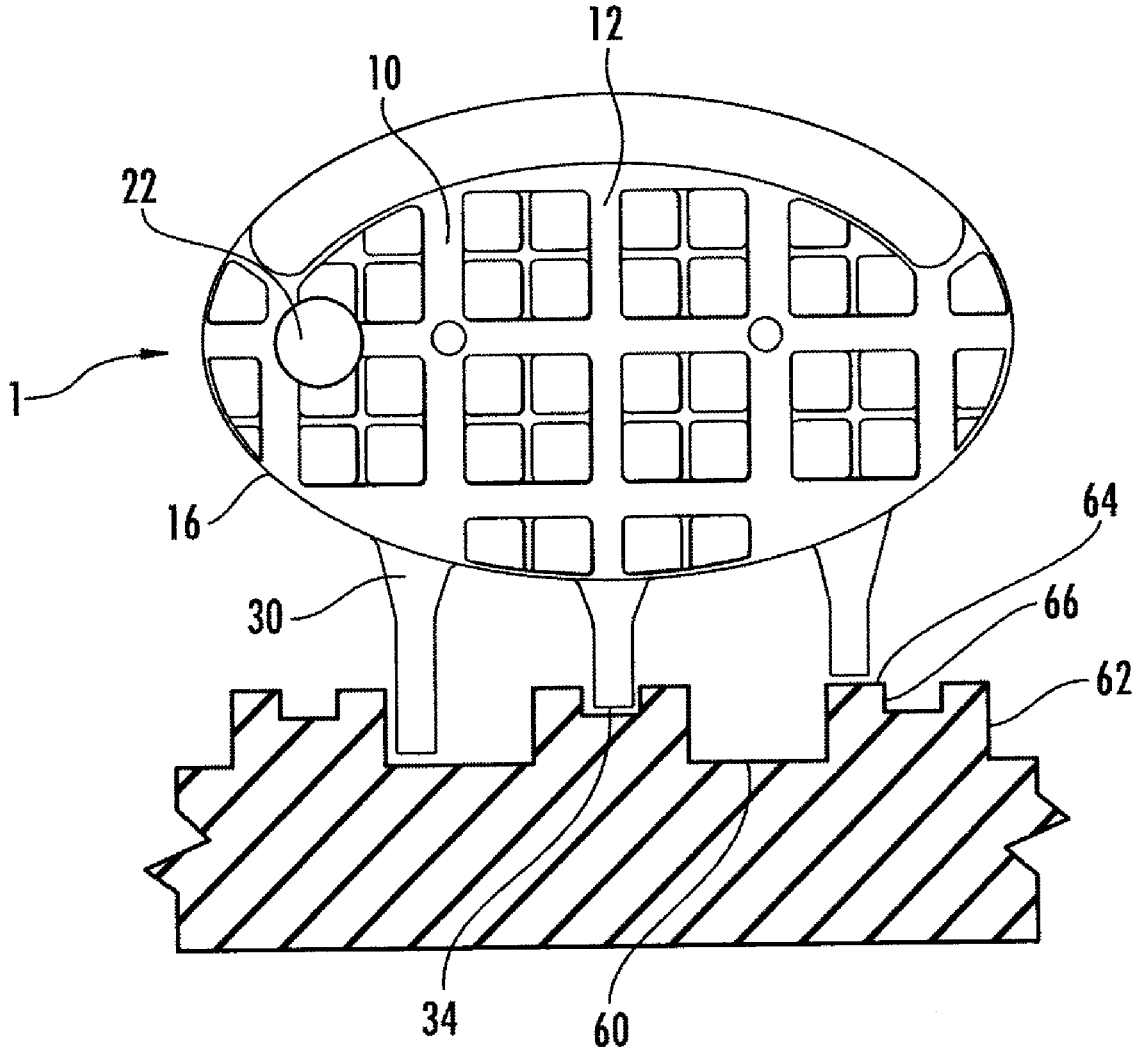
FIG. 5 is a cross-sectional view of a shoe sole and an embodiment of the outsole grid cleaner of the present invention applied to the shoe sole.

Extending from the outer peripheral surface 18 of the sidewall 16 is at least one scraper prong 30. The preferred embodiment of the outsole grid cleaner 1 illustrates three scraper prongs 30; however, a plurality of scraper prongs 30 have been contemplated. The scraper prongs 30 have an outer surface 32 and a distal end 34. The scraper prongs 30 have a circular cross-section. The scraper prong's cross-sectional construction is determined by the contemplated shoe sole. If the groove 60 between the projections 62, or the channel 66 on the top surface 64 of the projection 62 on the outsole of the shoe, better shown in FIGS. 4 and 5, are rectilinear then the scraper prongs 30 would be more suited to have a rectilinear or circular cross-section; thus other suitable cross-sections are contemplated for the scraper prongs 30 depending on the sole pattern. In the preferred embodiment, the scraper prong's 30 have a continuous diameter from the outer peripheral sidewall surface 18 to the distal end 34. However, a scraper prong having a circular cross-section which increases in diameter from the outer peripheral sidewall surface 18 to the distal end 34 is contemplated. Furthermore, the diameter on each scraper prong 30 should not exceed the width of the groove 60 on the corrugated pattern on a shoe sole.

As shown in FIG. 4, the outsole grid cleaner 1 is contemplated to be used in conjunction with shoes manufactured by SHOES FOR CREWS®, however the outsole grid cleaner 1 should not be limited to use with only this manufacturer. The shoe comprises of an outsole 50 having a corrugated pattern 52 thereon. As noted above, various patterns are contemplated for use, such as herringbone or the like. In the preferred embodiment, the corrugated pattern 52 is positioned on the heel portion 54 and front portion 56 of the sole; however, the corrugated pattern 52 may be positioned anywhere on the sole 50. The corrugated pattern 52 has a plurality of projections 62 positioned an equispaced distance apart from each other; each projection 62 has a top surface 64. The top surface 64 of each projection 62 may additionally have a channel 66 to help with traction. The channels 66 are cut outs formed on the top surface 64 of each projection 62. Each channel 66 is an equispaced distance from another channel 66 on the top surface 64 of a projection 62. The channels 66 have a square cross-section. The equispaced distance between the pluralities of projections 62 defines a plurality of grooves 60. The grooves 60 are similarly positioned an equispaced distance apart from each other.

In one embodiment, shown in FIG. 4, the plurality of scraper prongs 30 are positioned an equispaced distance apart from each other on the continuous sidewall 16. The equispaced distance on the scraper prongs 30 may correspond to adjacent grooves 60 between projections 62 on a shoe sole, or correspond to adjacent channels 66 on the top surfaces 64 of the projections 62 on a shoe sole, or correspond to adjacent top surfaces 64 on the projections 62 on a shoe sole. The scraper prongs 30 have staggered lengths. Each scraper prong 30 has a length that is different from the adjacent scraper prong 30, and the lengths of the scraper prongs 30 progressively increase along the continuous sidewall 16. Furthermore, the staggered lengths of the scraper prongs 30 allow the distal ends 34 of the scraper prongs 30 to simultaneous remove dirt and debris from adjacent grooves 60, adjacent channels 66, or adjacent top surfaces 64. However, it is contemplated that the scraper prongs 30 may all have similar lengths.

In another embodiment, shown in FIG. 5, the plurality of scraper prongs 30 are positioned a distance apart from each other so that the longest scraper prong 30 cooperates with a groove 60, the adjacent scraper prong 30 cooperates with a channel 66, and the adjacent scraper prong cooperates with the top surface 64 of a projection 62. This distance allows the distal ends 34 of the scraper prongs 30 to simultaneous remove dirt and debris from a groove 60, channel 66, and top surface 64 of a projection 62, simultaneously. The staggered heights on the scraper prongs 30 allows for easily facilitating of the scraper prongs 30 through the grooves 60, channels 66, and top surfaces 64 on the projection 62 on the corrugated pattern 52 on a shoe sole should the corrugated pattern 52 be aligned at an angle. The plurality of scraper prongs 30 are preferably constructed of a plastic polymer or other suitable material.

As shown in FIG. 4, in use, one embodiment of the outsole grid cleaner 1 is held by an individual on the top surface 12 and bottom surface 14 of the base 10. In this embodiment, the scraper prongs 30 are equispaced the same distance as the equispaced distance between adjacent grooves 60, adjacent channels 66, or adjacent top surfaces 64. The individual orients the base 10 in a matter whereby the plurality of scraper prongs 30 are in an axial direction with adjacent grooves 60 between the projections 62 on the corrugated pattern 52 on a shoe sole 50. Depending on the intended use, the scraper prongs 30 as constructed with a cross-section corresponding to the cross-section of the grooves 60, or the channels 66, or the top surfaces 64 of the projections 62. The scraper prongs 30 on the outsole grid cleaner 1 are then manipulated through adjacent grooves 60 between the projections 62. Each scraper prong 30 is positioned within a groove 60 and forcibly removes debris and dirt from the groove 60 when the dirt and debris comes in contact with the scraper prong's distal end 34 or outer surface 32. Furthermore, the plurality of scraper prongs 30 on the outsole grid cleaner 1 may be manipulated through adjacent top surfaces 64 on the projections 62 on the shoe sole' corrugated pattern 52. Each scraper prong 30 is positioned on a top surface 64 of the projection 62 and forcibly removes debris and dirt from the top surface 64 when the dirt and debris comes in contact with the scraper prong's distal end 34 or outer surface 32. Additionally, the plurality of scraper prongs 30 on the outsole grid cleaner 1 may be manipulated through adjacent channels 66 on the top surfaces 64 of the projections 62 on the shoe sole' corrugated pattern 52. Each scraper prong 30 is positioned within adjacent channels 66 on the top surfaces 64 of the projections 62 and forcibly removes debris and dirt from the adjacent channels 66 when the dirt and debris comes in contact with the scraper prong's distal end 34 or outer surface 32.

As shown in FIG. 5, in use, another embodiment of the outsole grid cleaner 1 is held by an individual on the top surface 12 and bottom surface 14 of the base 10. In this embodiment, the scraper prongs 30 are positioned a distance apart from each other so that the longest scraper prong 30 cooperates within a groove 60, the adjacent scraper prong 30 cooperates within a channel 66, and the adjacent scraper prong 30 cooperates with the top surface 64 of a projection 62, simultaneously. Similarly, each scraper prong 30 has a cross-section corresponding to a groove 60, a channel 66, and a top surface 64 of a projection 62, respectively in that order. Because of the differing length of one scraper prong 30 to the adjacent scraper prong 30, the scraper prong 30 with the longest length may be manipulated through the groove 60 and the adjacent shorter scraper prong 30 may be manipulated through the channel 66 on the top surface 64 of the projection 62 and the adjacent shorter scraper prong 30 may be manipulated through the top surface 64 of the projection 62 to remove dirt and debris therefrom simultaneously. It should be noted that the scraper prong's cross-section cooperates with the cross-section of the groove and channel to remove dirt and debris.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An outsole grid cleaner for cleaning and removing debris and dirt from the soles of shoes comprising:

a base having at least one continuous sidewall; and a plurality of scraper prongs extending from one said continuous sidewall, each said scraper prong having a circular cross-section of a similar diameter with a distal end and an outer surface, said plurality of scraper prongs are positioned an equispaced distance apart from each other on said at least one continuous sidewall whereby said equispaced distance corresponds to the distance on a shoe sole's pattern, each of said plurality of scraper prongs having a length that is different from an adjacent said scraper prong such that when said plurality of prongs are manipulated through a shoe sole's pattern debris and dirt are forcibly removed therefrom when in contact with said plurality of scraper prong's distal ends or said outer surfaces.

2. The outsole grid cleaner according to claim 1, wherein said lengths of each of said plurality of scraper prongs progressively increase as said plurality of scraper prongs extend along said at least one continuous sidewall.

3. The outsole grid cleaner according to claim 1, wherein said base includes an aperture therethrough.

4. The outsole grid cleaner according to claim 1, wherein said base includes a top surface and a bottom surface, and said at least one continuous sidewall extends between said top surface to said bottom surface.

5. The outsole grid cleaner according to claim 4, wherein said top surface includes a plurality of projections arranged in a pattern, whereby said plurality of projections enable gripping of said outsole grid cleaner by an individual.

6. The outsole grid cleaner according to claim 5, wherein said pattern is a corrugated pattern.

7. A combination of a shoe and an outsole grid cleaner for cleaning and removing debris and dirt from a shoe sole the combination comprising:

a shoe including a sole, said sole having a pattern of projections, said projections being positioned an equispaced distance apart from each other defining a plurality of grooves between each one of said projections, said plurality of grooves being positioned an equispaced distance apart from each other, each one of said projections having a top surface, on each said top surface includes a channel thereon; and an outsole grid cleaner including a base having at least one continuous sidewall, and a plurality of scraper prongs extending from said at least one said continuous sidewall, said plurality of scraper prongs having a distal end and an outer surface, said scraper prongs positioned a pre-determined distance apart from each other on said at least one continuous sidewall, each of said scraper prongs having a length that is different from an adjacent said scraper prong, said lengths of said scraper prongs progressively increasing as said scraper prongs extend along said at least one continuous sidewall, whereby said predetermined distance on said scraper prongs corresponds to said grooves and corresponds to said top surface on said projection on said shoe sole;

whereby said plurality of scraper prongs on said outsole grid cleaner removes debris and dirt from said pattern on said shoe sole when in contact with said plurality of scraper prong's distal end or said outer surface.

8. The combination shoe and outsole grid cleaner according to claim 7, wherein said plurality of scraper prong's said predetermined distance is an equispaced distance apart from each other, whereby said plurality of equispaced scraper prongs are manipulated through adjacent said grooves, or adjacent said channels, or adjacent said top surfaces to forcibly remove debris and dirt from said pattern on said shoe sole when in contact with said plurality of scraper prong's distal end or said outer surface.

9. The combination shoe and outsole grid cleaner according to claim 7, wherein said plurality of scraper prong's said predetermined distance is the distance between said groove to said channel and the distance between said channel to said top surface, whereby said plurality of scraper prongs are simultaneously manipulated through one said groove, said channel, and said top surface to forcibly remove debris and dirt from said pattern on said shoe sole when in contact with said plurality of scraper prong's distal end or said outer surface.

10. The combination shoe and outsole grid cleaner according to claim 7, wherein said pattern of said projections is a corrugated pattern.

11. The combination shoe and outsole grid cleaner according to claim 7, wherein each said plurality of scraper prongs have a circular cross-section.

12. The combination shoe and outsole grid cleaner according to claim 7, wherein each of said plurality of scraper prongs has a similar diameter.

13. The combination shoe and outsole grid cleaner according to claim 12, wherein each said similar diameter on plurality of said scraper prongs corresponds to said groove on said shoe sole.

14. The combination shoe and outsole grid cleaner according to claim 12, wherein each said similar diameter on said plurality of scraper prongs corresponds to said channel on a said shoe sole.

15. The combination shoe and outsole grid cleaner according to claim 7, wherein said base includes an aperture therethrough.

16. The combination shoe and outsole grid cleaner according to claim 7, wherein said base includes a top surface and a bottom surface, and said at least one continuous sidewall extends between said top surface to said bottom surface.

17. The combination shoe and outsole grid cleaner according to claim 16, wherein said top surface includes a second plurality of projections arranged in a pattern, whereby said plurality of projections enable gripping of said outsole grid cleaner by an individual.

* * * * *